US005769922A

United States Patent [19]

Higgins et al.

[11] Patent Number: 5,769,922

[45] Date of Patent: Jun. 23, 1998

[54] METHOD FOR PRODUCING VANADIUM-ALUMINUM-RUTHENIUM MASTER ALLOYS AND MASTER ALLOY COMPOSITIONS

[75] Inventors: Brian J. Higgins, Reading; James D. Kahl, deceased, late of Robesonia, by Marcia A. Kahl, legal representative; James D. Kahl, Jr., legal representative, Womelsdorf; Teri Ann Boyer, legal representative, Laureldale; Jeni L. Heenley, legal representative, Newmanstown, all of Pa.

[73] Assignee: Reading Alloys, Inc., Robesonia, Pa.

[21] Appl. No.: 631,405

[22] Filed: Apr. 12, 1996

[51] Int. Cl.[6] ..... C22B 4/06

[52] U.S. Cl. ..... 75/351; 75/369; 75/622

[58] Field of Search ..... 75/345, 351, 369, 75/10.27, 10.55, 10.58, 622

[56] References Cited

U.S. PATENT DOCUMENTS

| | | | |
|---|---|---|---|
| 1,727,180 | 9/1929 | Saklatwall | 420/424 |
| 2,789,896 | 4/1957 | Coffer | 75/614 |
| 3,625,676 | 12/1971 | Perfect | 420/552 |
| 4,104,059 | 8/1978 | Perfect | 420/580 |
| 4,105,442 | 8/1978 | Fieberg et al. | 75/720 |
| 4,256,487 | 3/1981 | Bobkova et al. | 75/10.58 |
| 4,419,127 | 12/1983 | Tanson | 75/10.55 |
| 5,002,730 | 3/1991 | Fetcenko | 420/424 |

*Primary Examiner*—George Wyszomierski

*Attorney, Agent, or Firm*—Eckert Seamans Cherin & Mellott

[57] ABSTRACT

Vanadium-aluminum master alloys with small amounts of refractory metals such as ruthenium, are made substantially free of refractory inclusions and with a substantially homogeneous microstructure by reacting vanadium oxides with excess aluminum through an aluminothermic reduction reaction in the presence of the refractory to yield the desired master alloy. A preferred homogeneous vanadium-aluminum-ruthenium alloy without inclusions contains from about 59 to 70% of vanadium, about 29 to 40% of aluminum, and about 1 to 10% of ruthenium, all based on the weight of the alloy. The substantially homogeneous and inclusion-free master alloy is then used to produce titanium base alloys of higher quality, such as 4% vanadium and 6% aluminum titanium base alloys containing small amounts of refractory metals, usually containing from about 0.1 to 1.0% of ruthenium.

9 Claims, 2 Drawing Sheets

METHOD FOR PRODUCING VANADIUM-ALUMINUM-RUTHENIUM MASTER ALLOYS AND MASTER ALLOY COMPOSITIONS

FIELD OF THE INVENTION

The invention relates to titanium base alloys, and more particularly to vanadium-aluminum master alloys containing small amounts of refractory metals, such as ruthenium, which are suitable for further alloying into titanium base alloys. The invention also relates to methods for producing vanadium-aluminum master alloys containing refractory materials, such as ruthenium, which are useful in providing titanium base alloys containing refractory materials of greater homogeneity.

BACKGROUND OF THE INVENTION

Titanium metal and titanium base alloys are lightweight, relatively strong metals, with high heat and corrosion resistance. These materials are in great demand today as preferred materials for use in aircraft, spacecraft and military applications. Titanium base alloys, such as those which contain 4% vanadium and 6% aluminum, are used, for example, in the blades of jet propulsion engines for aircraft by reason of their high strength in both hot and cold environments, and their resistance to oxidation and corrosion.

In the past, such 4% vanadium and 6% aluminum titanium base alloys have generally been prepared from vanadium-aluminum master alloys, particularly those containing 65% vanadium and 35% aluminum. In order to minimize the quantity of contaminants, interstitials and inclusions in the final titanium base alloy, considerable effort has been given to producing vanadium-aluminum master alloys of the highest purity.

Vanadium-aluminum master alloys, such as the 65% vanadium and 35% aluminum alloy, can be prepared by aluminothermic reduction of vanadium pentoxide in the presence of a molten flux. During the reaction, vanadium pentoxide is reduced by aluminum as the reducing agent to pure vanadium metal which alloys with aluminum present in excess of that required for the reduction. Alumina is formed as slag, and enters the molten flux which floats on the top of the alloy. The thermite reaction is highly exothermic and self-propagating once ignited.

U.S. Pat. No. 3,625,676 (Perfect) discloses an improved vanadium-aluminum master alloy from which titanium base alloys can be prepared, such as those which contain 4% vanadium and 6% aluminum. The master alloy, for example containing about 40% vanadium, 60% aluminum and small amounts of titanium, yields an alloy free of slag voids and gross nitride inclusions and results in improved physical properties and greater soundness in the titanium base alloy. The vanadium-aluminum-titanium master alloys of Perfect are prepared by aluminothermic co-reduction of vanadium pentoxide and titanium dioxide in the presence of excess aluminum and a molten flux. The vanadium-aluminum master alloy thereby produced includes from about 40 to 55% vanadium, from about 60 to 40% aluminum, and from about 0.5 to 5% titanium. U.S. Pat. Nos. 2,789,896 (Coffer); 4,256,487 (Bobkova, et al.); and 5,002,730 (Fetcenko) disclose other methods for producing vanadium-containing alloys by metallothermic reduction of vanadium oxide to vanadium metal.

Use of a vanadium-aluminum master alloy in the production of titanium base alloys has been proved desirable in obtaining substantially complete dissolution of the higher melting point vanadium in the lower melting point titanium base metal. Vanadium is reported to have a melting point of 1,890° C., as compared to the melting point of 1,660° C. for titanium. The vanadium-aluminum master alloy forms a eutectic with a lower melting point than vanadium and which more readily dissolves in the titanium base metal, and forms a base alloy free of vanadium inclusions.

In the past such 4% vanadium and 6% aluminum titanium base alloys have also included small amounts of refractory materials, such as ruthenium. These alloys have generally been prepared by blending ruthenium in the final base alloy charge containing the vanadium-aluminum master alloy and titanium sponge. The final titanium base alloy is formed by vacuum, consumable-electrode arc melting. However, in the production of such titanium base alloys with refractory ruthenium, difficulties have been encountered in obtaining complete dissolution of the substantially higher melting point ruthenium metal in the titanium base metal, which has a much lower melting temperature. Ruthenium is reported to have a melting point of 2,310° C., as compared to the melting point of 1,660° C. for titanium. As a result of this incomplete dissolution, ruthenium particles, which have a specific gravity of 12.5, as compared to 4.5 for titanium, segregate and drop, in unmelted form, to the bottom of the molten titanium pool, and form inclusions in the ingot produced.

Complete dissolution of ruthenium and/or other refractory metals in the titanium base alloy is highly desirable, because a single undissolved, sizable inclusion of the refractory metal in the alloy ingot may make the ultimate alloy unfit for many possible uses. The inclusions carry over through remelts as well, so that the ultimate alloy and products produced from it contain inclusions. Such inclusions in a finished article subject to mechanical stress, such as the blades of an aircraft jet propulsion engine, have a stress raising character, and could cause the part to crack or rupture catastrophically.

What is needed is a method of producing a homogeneous, inclusion free, vanadium-aluminum master alloy including small amounts of refractory metals such as ruthenium, which is suitable for alloying with titanium to produce a titanium base alloy. What is further needed is a method of producing a titanium base alloy containing refractory metals such as ruthenium, which have a homogeneous microstructure, are free of refractor inclusions and are made from an inclusion free, homogeneous vanadium-aluminum master alloy containing refractory metals.

SUMMARY OF THE INVENTION

It is an object of the present invention to provide master alloys containing vanadium and aluminum, and also refractory metals such as ruthenium, which are substantially free of refractory inclusions and are suitable for subsequent alloying into substantially homogeneous titanium base alloys.

It is another object of the present invention to provide a method for preparing substantially homogeneous vanadium-aluminum master alloys containing refractory metals such as ruthenium, for use in preparation of titanium base alloys containing refractory metals, without requiring expensive apparatus or materials, while resulting in master alloys and final alloys of excellent quality and yields.

It is yet another object of the present invention to provide a method of producing titanium base alloys containing refractory metals free of refractory inclusions.

It is still another object of the present invention to provide a method of obtaining substantially complete dissolution and/or distribution of refractory metals, such as ruthenium, in titanium base alloys.

The present invention resides in a method for producing a vanadium-aluminum-ruthenium master alloy which is substantially homogeneous and free of ruthenium inclusions, which includes the steps of: (a) mixing together a powdered charge of vanadium pentoxide, ruthenium and excess aluminum in appropriate proportions to yield the desired final master alloy composition; (b) igniting the powdered charge in the presence of a molten flux, such as lime, fluorspar, or sodium chlorate, to aluminothermically react the vanadium pentoxide with the excess aluminum in the presence of ruthenium, all contained in the powdered charge, whereby the vanadium pentoxide is reduced to molten vanadium metal which alloys with molten aluminum and ruthenium and is formed into a molten vanadium-aluminum-ruthenium master alloy together with molten alumina slag; (c) gravitationally separating the molten vanadium-aluminum-ruthenium alloy from the alumina slag; and, (d) cooling said vanadium-aluminum-ruthenium alloy to a solid ingot.

The present invention also resides in a vanadium-aluminum-ruthenium master alloy produced by the aforementioned aluminothermic reduction reaction in which the master alloy contains from about 49 to 85% by weight of vanadium, from about 14 to 50% by weight of aluminum, and from about 1 to 10% by weight of ruthenium, preferably from about 59 to 70% by weight of vanadium, from about 29 to 40% of aluminum, and from about 1 to 10% ruthenium.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS OF THE INVENTION

Figure 1:
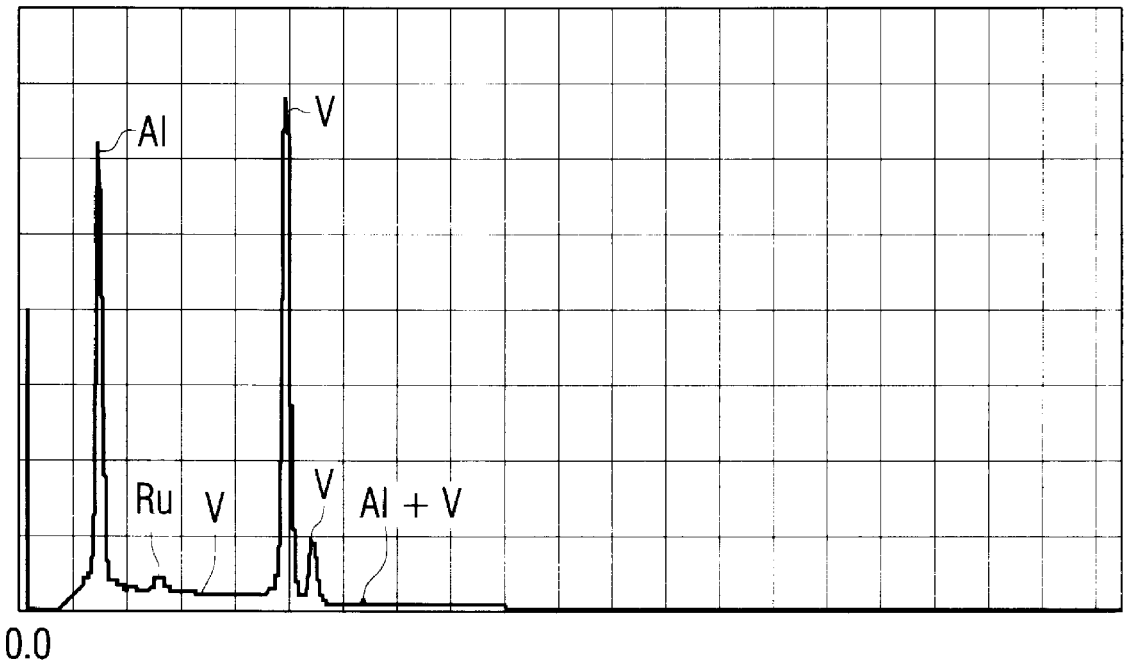
FIG. 1 is a scanning electron micrograph (SEM) of a cross-section of an ingot of vanadium-aluminum-ruthenium master alloy produced in accordance with the method of the present invention, and exhibiting no ruthenium inclusions; and, FIG. 2 is an energy dispersive x-ray spectrograph (EDS) of the vanadium-aluminum-ruthenium master alloy of FIG. 1, showing a plot of intensity versus energy of x-rays given off by the master alloy when bombarded by the electron beam of the SEM.

The present invention is directed to a method for preparing vanadium-aluminum master alloys containing refractory metals, such as ruthenium, which are substantially homogeneous and free of refractory inclusions, and which are suitable for producing titanium base alloys containing refractory metals of high quality. The present invention is especially useful in the production of vanadium-aluminum-ruthenium master alloys, such as those which contain about 65% vanadium and 35% aluminum and also contain small amounts of ruthenium, which are free of ruthenium inclusions and are used to produce titanium base alloys, such as those which contain 4% vanadium and 6% aluminum, as well as refractory ruthenium.

According to this invention, it was discovered that the refractory inclusion problems could be overcome if the aluminothermic reduction of vanadium oxide to vanadium metal was carried out in the presence of a small amount of ruthenium metal as well as excess aluminum. While it is believed that the ruthenium does not play any substantial part in the reduction reaction, the latent heat of the reaction provides enough energy to homogeneously alloy the ruthenium with the vanadium-aluminum thermite so as to avoid ruthenium inclusions. Titanium base alloys produced from such master alloys also were found to be free of ruthenium inclusions.

The invention is described in greater detail hereinafter with reference to preparing exemplary nominally 65% vanadium and 35% aluminum master alloys containing small amounts of ruthenium. However, the invention is not limited to any particular master alloy composition and can include, without limitation, vanadium, aluminum, and refractory metals such as ruthenium, present in the ranges stated herein.

In practicing the method of the invention, vanadium oxide, in powdered form, such as vanadium pentoxide, ruthenium, in powdered form, such as pure ruthenium metal, and aluminum, in powdered form, such as aluminum fines, are intimately mixed so that the aluminothermic reaction will occur rapidly and uniformly throughout the charge once it is ignited. More aluminum is added than is necessary to react with the vanadium oxide in order to produce an alloy of the metals vanadium, aluminum and ruthenium. The aluminothermic reduction reaction using vanadium pentoxide as the metal oxide and aluminum as the reducing agent can be written according to Equation 1.

$$10\ Al+3V_2O_5 \leftrightarrows 6V+5Al_{2O3} \quad (1)$$

The mixed powdered master alloy charge is ignited in a reaction vessel for propagation of the reaction according to Equation 1. Various types of reaction vessel can be employed. For example, a copper pot or crucible may be used. Since the reduction reaction is exothermic, a reaction vessel with a water jacket to control the temperature is preferred. Furthermore, inasmuch as the reduction reaction produces two separate layers, i.e., an alloy layer covered by a molten layer of slag-containing flux, a reaction vessel having a tap hole toward the bottom may be employed to aid in the separation of alloy from the slag. If desired, the reaction vessel can also be constructed as to permit carrying out of the aluminothermic reduction reaction in an atmosphere of inert gas, such as argon. Yet, it is most preferred to carry out the aluminothermic reduction reaction in an open air atmosphere at atmospheric pressure. A preferred type of reaction vessel used for the practice of the invention is a water-cooled, copper, below-ground reaction vessel, described in U.S. Pat. No. 4,104,059 (Perfect), which disclosure is incorporated by reference herein in its entirety.

The reaction mixture can be ignited by heating the charge above the melting point of the aluminum, for example using an electric arc, gas burner, or hot metal bar. Once ignited, the reduction reaction reaches temperatures in excess of about 2,400° C. which are sufficient to propagate heat through the charge to dissolve and homogenize the components of the resultant master alloy. After the thermite master alloy is prepared, it is cooled to form an ingot, and if desired can be size reduced into pieces by crushers, mills, of grinders to form a powdered master alloy for further alloying into a titanium base alloy.

To be successful, substantially all of the reaction products resulting from the ignition of the charge must be melted and remain in the molten state long enough to perm separation of the alloy from the slag, i.e., alumina. The alloy and the slag separate due to the different specific gravities of the materials, and it is necessary for the molten materials to have substantial fluidity to segregate. Fluidity of the alumina slag can be enhanced by inclusion in the master alloy charge of certain inorganic materials which act as a flux to lower the viscosity of the slag and assist in slag formation. Typical of these materials include lime, fluorspar, or sodium chlorate or the like, which form a molten flux at reaction temperatures for absorption of the alumina slag. These materials generally remain unaffected by the reduction reaction. Preferably, the amount of flux employed generally ranges from 0.5 to 2 times the weight of the alumina slag formed in the process.

The vanadium oxide used in the reduction reaction may be derived from either chemically pure vanadium pentoxide or less pure commercial grade vanadium pentoxide. An advantageous aspect of the invention is its effectiveness in producing master alloys from the less pure grades of vanadium pentoxide. The refractory ruthenium metal present during the reduction reaction should be substantially pure ruthenium. If desired, other refractory metals may be employed in the master alloy, for example, cobalt, rhodium, palladium, platinum, etc. For aluminum, it is preferred to use the highest purity aluminum commercially available. Chopped aluminum wire containing low impurities can be employed. However, virgin aluminum powder or fines is the most preferred reducing agent employed. If desired, other reducing agents may be employed which have a greater affinity for oxygen than the vanadium metal of the vanadium oxide, for example, silicon, calcium, or magnesium. However, aluminum is most preferred since it is present in the master alloy composition and has a high heat of formation which increases the amount of heat released by the reduction reaction used for producing a molten mass of the reaction products.

The metal oxide, refractory metal and aluminum components may naturally vary in purity, and the proportions needed to provide a master alloy of a given composition will vary accordingly. For this reason, the respective amounts of materials used are expresses in terms of the compositions of the desired alloy. The amount of components should be so proportioned as to provide master alloys containing from about 49 to 85% of vanadium from about 14 to 50% of aluminum, and from about 1 to 10% ruthenium. Preferably the proportions of the components are such as to provide master alloys containing from about 59 to 70% of vanadium, from about 29 to 40% of aluminum, and from about 1 to 10% ruthenium. Unless otherwise specified, all percentages set forth herein refer to weight percent.

In accordance with the practice of this invention, the vanadium-aluminum-ruthenium master alloys produced will be substantially homogeneous and relatively free of ruthenium inclusions in the ingot. The master alloy produced also will be relatively free of slag voids and gross nitride inclusions.

The method of the invention is particularly useful in producing 65% vanadium and 35% aluminum master alloys containing small amounts of ruthenium, preferably 1 to 10% ruthenium. Such master alloys can be used to make various titanium base alloys, including the 4% vanadium and 6% aluminum alloy containing small amounts of ruthenium, preferably about 0.1 to 1.0% ruthenium, the balance being titanium.

In making the titanium base alloys using the master alloys of the invention, titanium or titanium sponge in appropriate proportions for the desired final alloy can be intimately mixed with powdered master alloy, and then the mixed charge can be formed into a consumable electrode and melted by a vacuum consumable-electrode arc melting, process to form the final titanium base alloy.

The invention will further be clarified by a consideration of the following non-limiting specific example, which is intended to be purely exemplary of the practice of the invention used to produce vanadium-aluminum-ruthenium.

EXAMPLE 1

A vanadium-aluminum-ruthenium master alloy containing about 62.5% by weight of vanadium, about 35.5% by weight of aluminum, and about 1.5% by weight ruthenium the balance being minor impurities, was prepared by the following process:

About 60 pounds vanadium pentoxide ($V_2O_5$) was intimately mixed together with about 53 pounds aluminum fines (Al) in excess, and about 1 pound ruthenium (Ru), an flux of about 3 pounds sodium chlorate ($NaClO_3$), about 7 pounds lime (CaO), and about 5 pounds fluorspar ($CaF_2$), to form a powdered charge. The powdered charge was the packed into a below ground, water-cooled, copper furnace and ignited with a sparkler to initiate the aluminothermic reduction reaction which ran in open air until completion. In this Example, the reaction mixture reached temperatures in excess of 2,400° C. and proceeded for about 30 seconds by which time substantially complete alloying had occurred. Upon completion of the reaction, the alloyed charge was cooled and removed from the reaction vessel, and then crushed into pieces, one of which was submitted for elemental analysis. The RAI compositional analysis is provided in Table 1.

TABLE 1

| RAI Analysis | |
|---|---|
| Element | Weight % |
| V | 62.51 |
| Al | 35.46 |
| Ru | 1.44 |
| B | 0.0004 |
| C | 0.032 |
| Fe | 0.229 |
| Mg | 0.0002 |
| Mo | 0.020 |
| P | 0.012 |
| Si | 0.225 |
| S | 0.003 |
| N | 0.025 |
| O | 0.087 |

Figure 2:
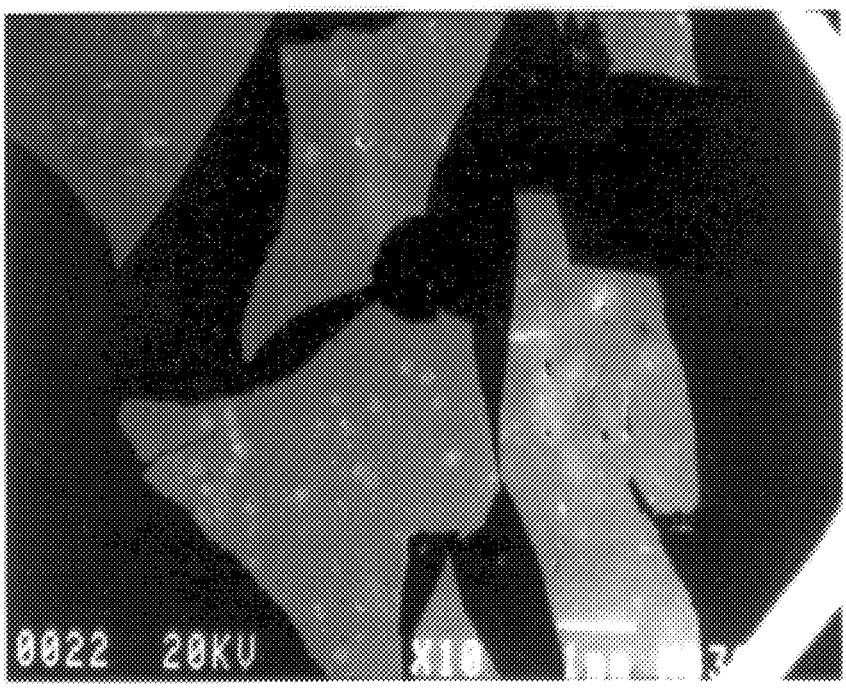

FIG. 1 is an SEM micrograph showing the microstructure of the V-Al-Ru master alloy produced in EXAMPLE 1. FIG. 2 is an EDS spectrograph showing the elemental map of the major components of the V-Al-Ru master alloy produced in EXAMPLE 1. The master alloy appeared to be uniformly alloyed, possibly comprising a two-phase microstructure, and contained no free ruthenium.

The U.S. patents mentioned in this specification are all incorporated by reference herein in their entireties.

The invention having been disclosed in connection with the foregoing embodiments and examples, additional variations will now be apparent to persons skilled in the art. The invention is not intended to be limited to the embodiments specifically mentioned, and accordingly reference should be made to the appended claims rather than the foregoing discussion of preferred embodiments, to assess the spirit and scope of the invention in which exclusive rights are claimed.

We claim:

1. A method for producing a vanadium-aluminum-ruthenium alloy which is substantially free of ruthenium inclusions, which comprises:

a. mixing together a powdered charge of vanadium pentoxide, ruthenium and aluminum;

b. reacting said vanadium pentoxide with said aluminum in the presence of said ruthenium, all components being in the powdered charge, by an aluminothermic reduction reaction, whereby said vanadium pentoxide is reduced to vanadium metal which alloys with the aluminum and ruthenium, to form molten vanadium-aluminum-ruthenium alloy and an alumina slag;

c. separating said molten vanadium-aluminum-rutheniumalloy from said alumina slag; and, d. cooling said vanadium-aluminum-ruthenium alloy to a solid ingot.

2. The method of claim 1, in which in the mixing step (a), the amount or vanadium pentoxide, aluminum, and ruthenium are proportioned so as to provide a vanadium-aluminum-ruthenium alloy which comprises from about 49 to 85% by weight of vanadium, from about 14 to 50% by weight of aluminum, and from about 1 to 10% by weight of ruthenium.

3. The method of claim 1, in which the reacting step (b) is carried out in the presence of a molten flux in a sufficient amount to reduce the viscosity of the alumina slag and facilitate gravitational separation of the slag from the molten alloy in step (c).

4. The method of claim 3, in which the molten flux comprises at least one of lime, fluorspar; and sodium chlorate.

5. The method of claim 1, which further comprises:

e. alloying the vanadium-aluminum-ruthenium alloy with titanium to produce a titanium base alloy.

6. The method of claim 1, in which the reacting step (b) further comprises i. placing the powdered charge in an open air reaction vessel; and, ii. igniting said charge by taking the charge above the melting point of aluminum.

7. The method of claim 6, in which the reaction step (b) is conducted in a reaction vessel comprising a water-cooled, below-ground, copper furnace.

8. A method for producing a vanadium-aluminum-ruthenium alloy which is substantially free of ruthenium inclusions, which comprises:

a. mixing together a powdered charge of vanadium pentoxide, ruthenium and aluminum in appropriate proportions so as to provide a vanadium aluminum-ruthenium alloy containing from about 59 to 70% by weight of vanadium, from about 29 to 40% of aluminum, and from about 1 to 10% ruthenium;

b. reacting said vanadium pentoxide with said aluminum in the presence of said ruthenium, all components being in the powdered charge, by an aluminothermic reduction reaction in the presence of a molten flux, whereby said vanadium pentoxide is reduced to vanadium metal which alloys with aluminum and ruthenium, to form a molten vanadium-aluminum-ruthenium alloy and a molten flux-containing alumina slag;

c. separating and cooling said vanadium-aluminum-ruthenium alloy to form a solid ingot.

9. The method of claim 8, in which the molten flux comprises at least one of lime, fluorspar, and sodium chlorate.

* * * * *

UNITED STATES PATENT AND TRADEMARK OFFICE

CERTIFICATE OF CORRECTION

PATENT NO. : 5,769,922

DATED : June 23, 1998

INVENTOR(S) : Brian J. Higgins et al

It is certified that error appears in the above-indentified patent and that said Letters Patent is hereby corrected as shown below:

Drawings:

On drawing sheet 1 of 2, relabel Fig. 1 as Fig. 2.

On drawing sheet 2 of 2, relabel Fig. 2 as Fig. 1.

Column 2, line 47, delete "refractor" and substitute therefor --refractory--.

Column 4, line 34, delete the equation and susbtitute therefor --$10Al + 3V_2O_5 \leftrightharpoons 6V + 5Al_2O_3$--.

Column 4, line 63, delete "of" and substitute therefor --or--.

Column 5, line 1, delete "perm" and substitute therefor --permit--.

Column 5, line 41, delete "expresses" and substitute therefor --expressed--.

Column 6, line 18, delete "an" and substitute therefor --and--.

Column 6, line 21, delete "the" and substitute therefor --then--.

UNITED STATES PATENT AND TRADEMARK OFFICE

CERTIFICATE OF CORRECTION

PATENT NO. : 5,769,922

DATED : June 23, 1998

INVENTOR(S) : Brian J. Higgins, et. al.

It is certified that error appears in the above-identified patent and that said Letters Patent is hereby corrected as shown below:

Column 7, line 16, delete "rutheniumalloy" and substitute therefor --ruthenium alloy--.

Signed and Sealed this

Twelfth Day of January, 1999

*Attest:*

*Attesting Officer*

*Acting Commissioner of Patents and Trademarks*